US006256959B1

(12) United States Patent
Palmersten

(10) Patent No.: US 6,256,959 B1
(45) Date of Patent: Jul. 10, 2001

(54) BUILDING PANEL WITH VIBRATION DAMPENING CORE

(75) Inventor: Michael J. Palmersten, Woodbury, MN (US)

(73) Assignee: KJMM, Inc., Woodbury, MN (US)

( * ) Notice: Subject to any disclaimer, the term of this patent is extended or adjusted under 35 U.S.C. 154(b) by 0 days.

(21) Appl. No.: 09/417,637

(22) Filed: Oct. 14, 1999

(51) Int. Cl.[7] ..... E04C 3/30; E04B 1/80

(52) U.S. Cl. ..... 52/588.1; 52/309.9; 52/145; 181/292

(58) Field of Search ..... 52/589.1, 309.9, 52/612, 796.1, 793.1, 794.1, 592.1, 578, 588.1, 144, 145; 428/116, 118; 181/292, 284, 288

(56) References Cited

U.S. PATENT DOCUMENTS

| | | | | |
|---|---|---|---|---|
| D. 328,141 | | 7/1992 | Meyerson | D25/126 |
| 4,084,367 | * | 4/1978 | Saylor et al. | 181/292 X |
| 4,155,211 | * | 5/1979 | Saylor et al. | 52/145 X |
| 4,769,963 | | 9/1988 | Myerson | 52/309.9 |
| 4,807,411 | * | 2/1989 | Capaul | 52/144 |
| 4,998,396 | | 3/1991 | Palmersten | 52/595 |
| 5,009,043 | * | 4/1991 | Kurrasch | 52/145 |
| 5,022,943 | * | 6/1991 | Zaima | 181/292 X |
| 5,086,599 | | 2/1992 | Meyerson | 52/309.9 |
| 5,138,812 | | 8/1992 | Palmersten | 52/584 |
| 5,216,861 | | 6/1993 | Meyerson | 52/309.9 |
| 5,224,315 | * | 7/1993 | Winter, IV | 52/309.9 X |
| 5,318,734 | | 6/1994 | Palmersten et al. | 264/46.5 |
| 5,343,665 | | 9/1994 | Palmersten | 52/588.1 |
| 5,349,796 | | 9/1994 | Meyerson | 52/309.11 |
| 5,404,686 | * | 4/1995 | Esposito | 52/309.9 X |
| 5,448,865 | | 9/1995 | Palmersten | 52/309.9 |
| 5,457,917 | | 10/1995 | Palmersten | 52/91.3 |
| 5,664,386 | | 9/1997 | Palmersten | 52/588.1 |

* cited by examiner

*Primary Examiner*—Peter M. Cuomo
*Assistant Examiner*—James O. Hansen
(74) *Attorney, Agent, or Firm*—Crompton, Seager & Tufte, LLC

(57) ABSTRACT

A building panel includes a first skin which is bonded to a first face of a first foam sheet. A second face of the first foam sheet is fixed to a cellular network. The cellular network includes a first face, a second face, and a plurality of cells defined by a plurality of cell walls. The second face of the cellular network is fixed to a first face of a second foam sheet. A second skin is bonded to a second face of second foam sheet. In one embodiment, the first skin may include a first portion, a second portion, and a third portion. The first portion of first skin is bonded to the first face of the first foam sheet. The second portion of the first skin extends beyond the first foam sheet and forms a first interlocking member. The third portion of first skin extends beyond the first foam sheet and forms a first complementary interlocking member. The second skin of the building panel may also includes a first portion, a second portion, and a third portion. The first portion of second skin is bonded to the second face of the second foam sheet. The second portion of the second skin extends beyond the second foam sheet and forms a second interlocking member. The third portion of the second skin extends beyond the second foam sheet and forms a second complementary interlocking member.

9 Claims, 9 Drawing Sheets

BUILDING PANEL WITH VIBRATION DAMPENING CORE

FIELD OF THE INVENTION

The present invention relates to modular building panels utilized to fabricate the walls, ceilings, floors, etc. of cabanas, porches, and the like.

BACKGROUND OF THE INVENTION

The use of modular building panels is popular a popular method for economically adding additional enclosed structures to a pre-existing structure. Examples of new structures include room additions, cabanas, and enclosed porches. In many cases these room additional enclosures are used for leisure activities such as reading, watching television, and visiting with guests.

Typically modular building panels cost less than conventional construction materials. Modular building panels may be quickly disposed in an edge to edge configuration to form walls, roofs, etc. The assembly time required to build a structure with modular building panels is typically much less than when building using conventional construction methods. The time and labor savings provides additional cost savings.

Structures built with modular building panels are often exposed to the wind, sun rain, hail, and even seismic activity. It is desirable that structures built with modular building panels be durable enough to withstand exposure to these elements.

When a building panel is struck by an object such as a hail stone or a rain drop, the panel will resonate. If a person is inside a structure built with a large number of panels, during a hail storm or rain, the level of sound created by the impact of precipitation on the building panels is often objectionable. For example, in many cases it is difficult to carry on a conversation in the room because of the noise. Since enclosed structures built with modular building panels are typically intended for leisure activities it is desirable that the space inside the enclosure provide a peaceful place to entertain guests.

SUMMARY OF THE INVENTION

The present invention relates to modular building panels utilized to fabricate cabanas, porches, and the like. A building panel in accordance with the present invention includes a first skin which is bonded to a first face of a first foam sheet. A second face of the first foam sheet is fixed to a cellular network. The cellular network includes a first face, a second face, and a plurality of cells defined by a plurality of cell walls. The second face of the cellular network is fixed to a first face of a second foam sheet. A second skin is bonded to a second face of second foam sheet. Applicant has found that a building panel in accordance with the present invention is less likely to produce an objectionable level of sound when struck by an object such as a hail stone or a rain drop. Applicant has also found that panels in accordance with the present invention possess desirable levels of strength and durability.

In one embodiment of the present invention, a wall may be formed which includes a plurality of building panels and a plurality of joining members. In an additional embodiment of the present invention, a wall may be formed by joining a plurality of building panels together in a snap-fit edge to edge configuration.

In one embodiment, of the present invention, the first skin may include a first portion, a second portion, and a third portion. The first portion of first skin is bonded to the first face of the first foam sheet. The second portion of the first skin extends beyond the first foam sheet and forms a first interlocking member. The third portion of first skin extends beyond the first foam sheet and forms a first complementary interlocking member.

The second skin of the building panel may also includes a first portion, a second portion, and a third portion. The first portion of second skin is bonded to the second face of the second foam sheet. The second portion of the second skin extends beyond the second foam sheet and forms a second interlocking member. The third portion of the second skin extends beyond the second foam sheet and forms a second complementary interlocking member.

BRIEF DESCRIPTION OF THE DRAWINGS

FIG. 5 is a cross sectional view of an assembly including a plurality of building panels and a plurality of joining members in accordance with the present invention, the assembly of FIG. 5 may form a portion of a wall, a ceiling, a floor and the like;

FIG. 7 is a cross sectional view including a plurality of building panels arranged to form an assembly in accordance with the present invention, the assembly of FIG. 7 may form a portion of a wall, a ceiling, a floor, and the like;

FIG. 9 is a cross sectional view of an assembly formed by a plurality of building panels in accordance with the present invention, the assembly of FIG. 9 may form a portion of a wall, a ceiling, a floor, and the like.

DETAILED DESCRIPTION OF THE INVENTION

The following detailed description should be read with reference to the drawings, in which like elements in different drawings are numbered identically. The drawings which are not necessarily to scale, depict selected embodiments and are not intended to limit the scope of the invention. Examples of constructions, materials, dimensions, and manufacturing processes are provided for selected elements. Those skilled in the art will recognize that many of the examples provided have suitable alternatives which may be utilized.

Figure 1:
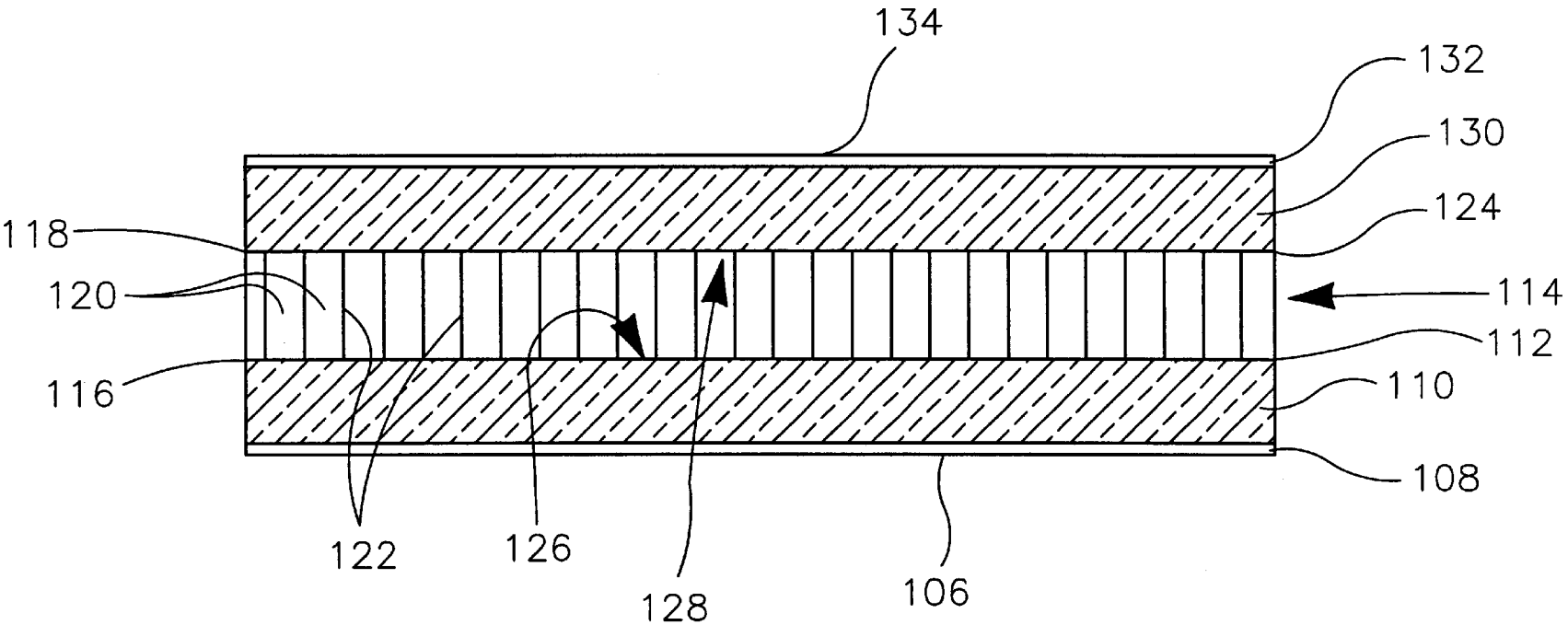
FIG. 1 is a cross sectional view of a building panel in accordance with the present invention.

FIG. 1 is a cross sectional view of a building panel 100 in accordance with the present invention. Building panel 100 includes a first skin 106 which is bonded to a first face 108 of a first foam sheet 110. A second face 112 of first foam sheet 110 is fixed to a cellular network 114. Cellular network 114 includes a first face 116, a second face 118, and a plurality of cells 120 defined by a plurality of cell walls 122. In the embodiment of FIG. 1, each cell 120 also includes a first opening 126 disposed proximate first face 116 of cellular network 114 and a second opening 128 disposed proximate second face 118 of cellular network 114. Second face 118 of cellular network 114 is fixed to a first face 124 of a second foam sheet 130. A second skin 134 is bonded to a second face 132 of second foam sheet 130.

In a presently preferred embodiment, first skin 106 and second skin 134 are comprised of aluminum. It is to be understood that first skin 106 and second skin 134 may be comprised of many materials without deviating from the spirit and scope of the present invention. Examples of materials which may be suitable in some applications include wood, oriented strand board (OSB), plywood, steel, vinyl clad aluminum, and polyvinylchloride (PVC).

In a presently preferred embodiment, first foam sheet 110 and second foam sheet 130 are comprised of a foamed thermoplastic material. Examples of thermoplastic materials which may be suitable in some applications include polystyrene and Acrylonitrile Butadiene Styrene (ABS). Fire retardant grades of ABS are commercially available from GE Plastics of Pittsfield Mass. which identifies the material by the trade name CYCOLAC. Those of skill in the art will appreciate that first foam sheet 110 and second foam sheet 130 may be comprised of other materials without deviating from the spirit and scope of the present invention. Examples of materials which may be suitable in some applications include gypsum, expanded polystyrene (EPS), and urethane.

Figure 2:
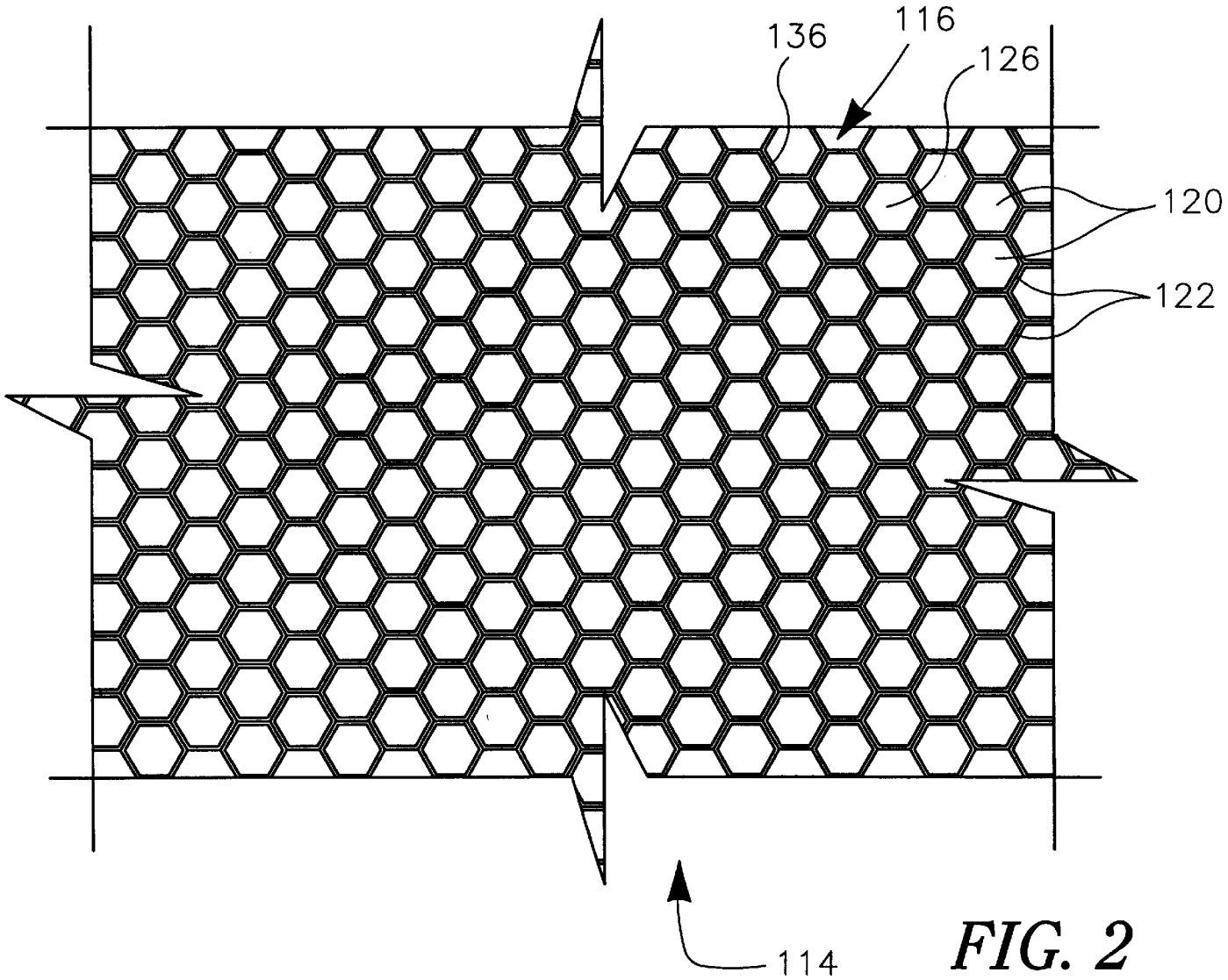
FIG. 2 is a plan view of an exemplary embodiment of a cellular network in accordance with the present invention.

FIG. 2 is a plan view of an exemplary embodiment of a cellular network 114. Cellular network 114 includes a plurality of cells 120 defined by a plurality of cell walls 122. Each cell wall 122 includes an upper edge 136. A first face 116 of cellular network 114 is defined by upper edges 136 of cell walls 122. Each cell 120 also includes a first opening 126 which is generally co-planar with first face 116.

In a presently preferred embodiment, cell walls 122 are comprised of kraft paper. In this presently preferred embodiment, the kraft paper may include various additives and coatings. Examples include flame retardant materials and water retardant materials. Flame retardant additives which may be suitable in some applications are commercially available from the Specialty Chemicals Division of Allied Signal located in Michigan Center, Mich. and Spartan Flame Retardants Incorporated of Crystal Lake, Ill.

It should be understood that cell walls 122 may comprise other materials without deviating from the spirit and scope of the present invention. Examples of materials which may be suitable in some applications include: polyethylene (PE), polypropylene (PP), polyvinylchloride (PVC), polyurethane, aluminum, paper, cardboard, and flame retardant thermoplastic materials. Examples of flame retardant thermoplastic materials include CYCOLAC, KYDEX, and NOMAX. CYCOLAC is an Acrylonitrile Butadiene Styrene (ABS) resin which is commercially available in fire retardant grades from GE Plastics of Pittsfield, Mass. KYDEX is an ABS material which is commercially available in sheet form from the Kleerdex Company of Aiken, S.C. NOMAX is commercially available from E.I. du Pont de Nemours and Company of Wilmington, Del. NOMAX fibers and floc may be formed into pressboard and paper.

A variety of methods may be utilized to form cellular network 114 of FIG. 2. One method may begin with the step of applying a first pattern of adhesive beads to a first sheet of material. In a presently preferred method, the adhesive beads form essentially straight lines which are substantially parallel to each other. Also in a presently preferred method, the spacing between adjacent beads is approximately two cell widths. A second sheet is then laminated to the first sheet. The adhesive beads bond selected portions of the first sheet to the second sheet. A second pattern of adhesive beads is then applied to the second sheet. The second pattern of adhesive beads is essentially identical to the first pattern of adhesive beads, except that its position is shifted so that each bead of adhesive in the second pattern falls approximately half way between two adhesive beads in the previous pattern. A third sheet is the laminated to the second sheet, and a third pattern of adhesive beads is applied to the third sheet. This procedure is repeated to create a stack having a plurality of sheets. When the assembly of the stack is complete, pulling forces are applied to the outermost sheets of the stack to form a cellular network. Equipment which may be used to apply a plurality of adhesive beads to a sheet of material is commercially available from Dick Moll and Sons of Warminster, Pa. and Black Brothers Equipment of High Point, N.C. Adhesives which may be suitable in some applications are commercially available from Morton Specialty Chemicals of Chicago, Ill.

When cellular network 114 is comprised of a thermoplastic material, the sheets of material comprising cellular network 114 may be selectively bonded using a thermoplastic welding process. Welding techniques which may be suitable in some applications include those which use convection, conduction, friction, and electromagnetic radiation to produce the heat required for welding. An example of the use of friction to heat/weld sheets of material is ultrasonic welding. Equipment suitable for ultrasonic welding sheets of material is commercially available from Forward Technologies of Plymouth, Minn. Examples of welding with electromagnetic radiation include radio frequency (RF) welding and laser welding. Equipment suitable for RF welding sheets of material is commercially available from Thermatron Corporation of Bayshore, N.Y. Examples of welding utilizing conducted heat include the use of an electric heating element covered with a non-stick buffer material. Equipment suitable for welding sheets of material using conducted heat is commercially available from Toss Machine Components of Nazareth, Pa. Examples of welding utilizing convection heating include impinging hot air on a selected region of the material and applying pressure to the heated region with a roller die. Equipment suitable for welding sheets of material with convection heating is commercially available from Pelland Industries of Sand Point, Id.

Figure 3:
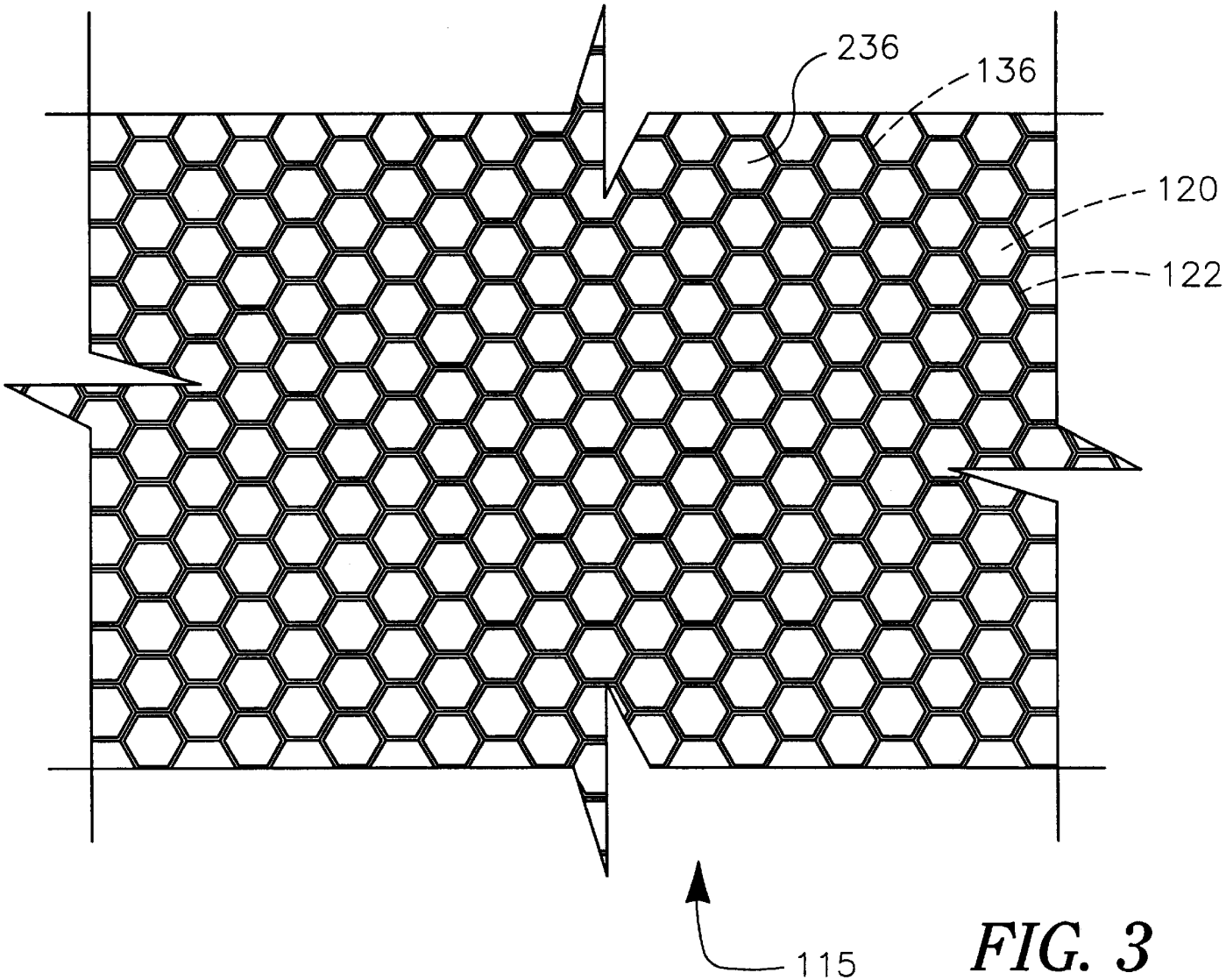
FIG. 3 is a plan view of an additional embodiment of a cellular network in accordance with the present invention.

FIG. 3 is a plan view of an additional embodiment of a cellular network 115. Cellular network 115 includes a plurality of cells 120 defined by a plurality of cell walls 122. Each cell wall 122 includes an upper edge 136. Cellular network 115 includes a cover 236 overlaying upper edges 136 of cell walls 122. Cellular network 115 also includes a second cover 237 (not shown) overlaying the opposite side. In a presently preferred embodiment, cover 236 and second cover 237 are fixed to cell walls 122 with an adhesive. Also in a presently preferred embodiment, cell walls 122 and cover 236 are comprised of kraft paper.

Figure 4:
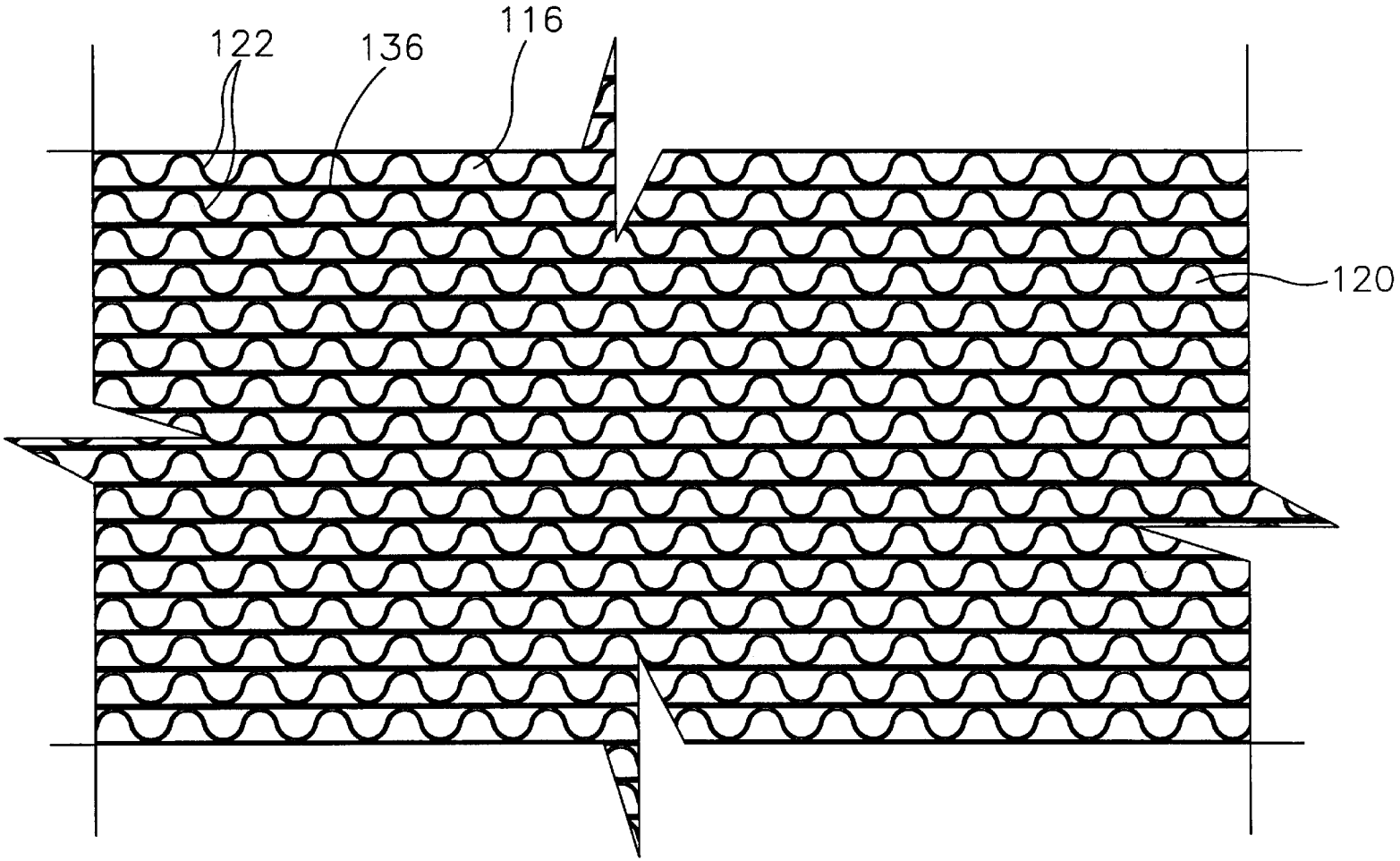
FIG. 4 is a plan view of another embodiment of a cellular network in accordance with the present invention.

FIG. 4 is a plan view of another embodiment of a cellular network 117. Cellular network 117 includes a plurality of cells 120 defined by a plurality of cell walls 122. Each cell wall 122 includes an upper edge 136. A first face 116 of cellular network 117 is defined by upper edges 136 of cell walls 122.

A method of forming cellular network 117 of FIG. 4 may begin with the step of feeding a sheet of material through a pair of intermeshed corrugating rollers to form a fluted sheet. Adhesive may then applied to the tips of the flutes on a first side of the fluted sheet. The first side of the fluted sheet may then be pressed against a substantially flat second sheet. As a result, the tip of each flute on the first side of the fluted sheet is bonded to the second sheet. Adhesive may then be applied to the tips of the flutes on a second side of the fluted sheet. The adhesive bearing flute tips are then pressed against a substantially flat third sheet to form a tri-sheet assembly. A plurality of tri-sheet assemblies may be bonded together to form a cellular network.

Figure 5:
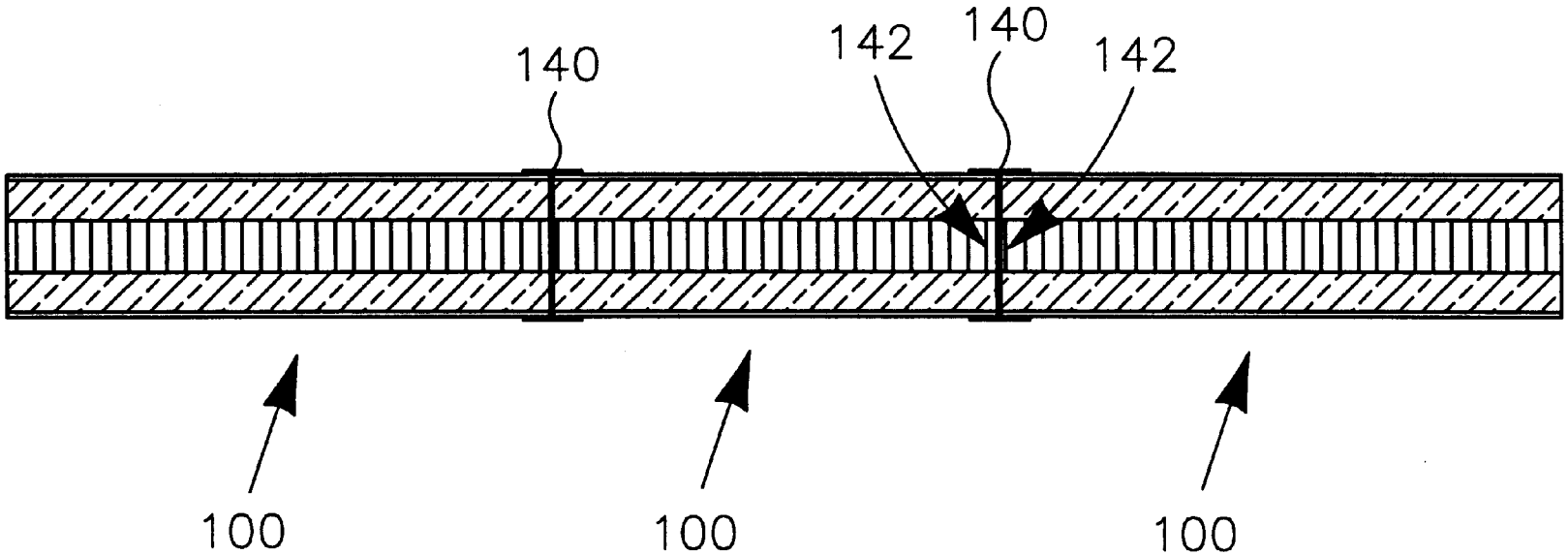

FIG. 5 is a cross sectional view of an assembly 138 including a plurality of building panels 100 and a plurality of joining members 140. Each joining member includes a plurality of cavities 142. Each cavity 142 is adapted to receive an end portion of a building panel 100.

Figure 6:
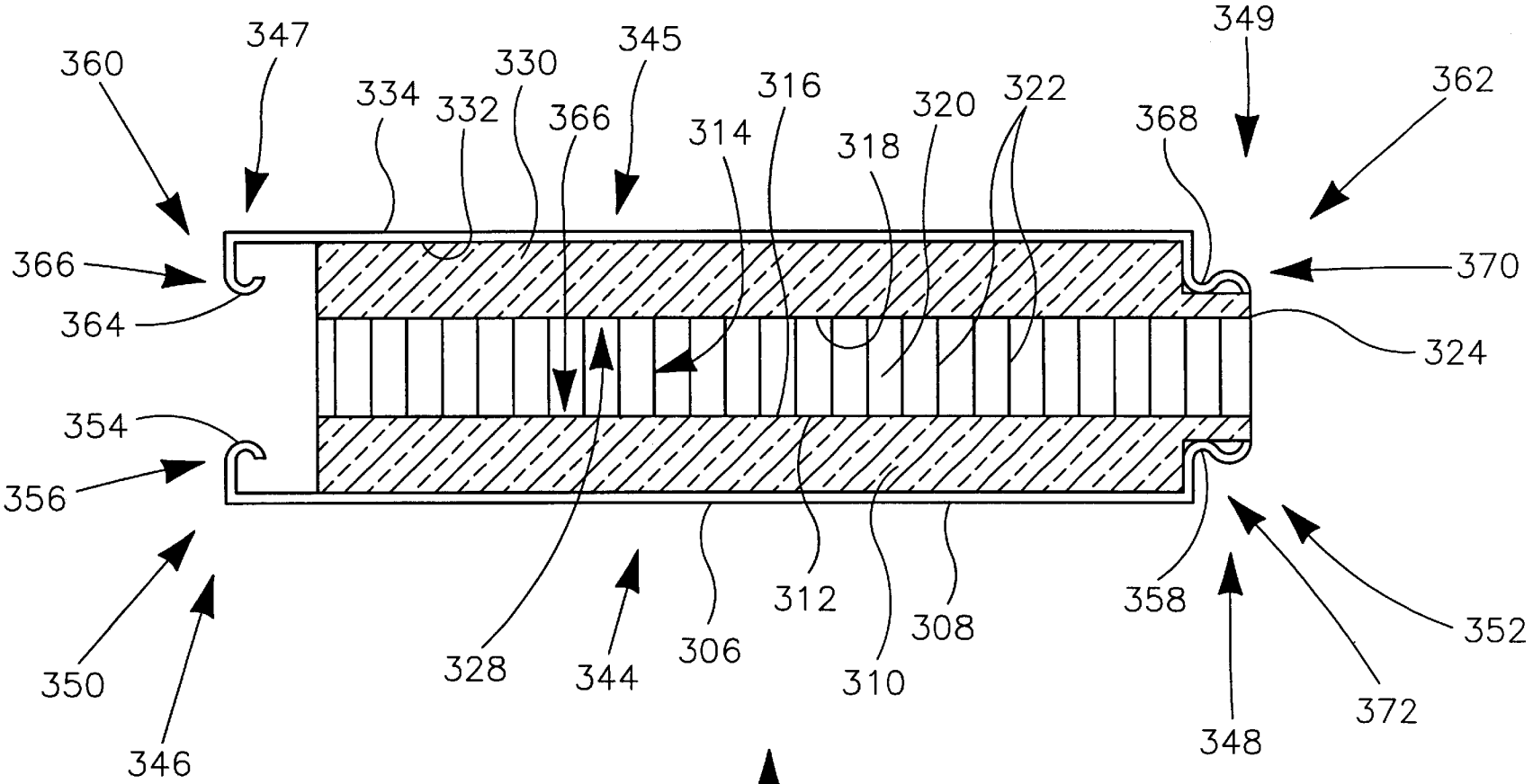
FIG. 6 is a cross sectional view of an additional embodiment of a building panel 100 in accordance with the present invention.

FIG. 6 is a cross sectional view of an additional embodiment of a building panel 300 in accordance with the present invention. Building panel 300 includes a first skin 306 and a first foam sheet 310 having a first face 308 and a second face 312. A first portion 344 of first skin 306 is bonded to a first face 308 of first foam sheet 310. A second portion 346 of first skin 306 extends beyond first face 308 of first foam sheet 310 and forms a first interlocking member 350. In the embodiment of FIG. 6, first interlocking member 350 includes a first convex surface 354 formed by a first curve 356 in first skin 306. A third portion 348 of first skin 306 extends beyond first face 308 of first foam sheet 310 and forms a first complementary interlocking member 352. In the embodiment of FIG. 6, first complementary interlocking member 352 includes a first concave surface 358 formed by a curve 372 in first skin 306.

A second face 312 of first foam sheet 310 is fixed to a cellular network 314. Cellular network 314 includes a first face 316, a second face 318, and a plurality of cells 320 defined by a plurality of cell walls 322. In the embodiment of FIG. 6, each cell 320 also includes a first opening 326 disposed proximate first face 316 of cellular network 314 and a second opening 328 disposed proximate second face 318 of cellular network 314. Second face 318 of cellular network 314 is fixed to a first face 324 of a second foam sheet 330. Second foam sheet 330 also has a second face 332.

Building panel 300 also includes a second skin 334. A first portion 345 of second skin 334 is bonded to second face 332 of second foam sheet 330. A second portion 347 of second skin 334 extends beyond second face 332 of second foam sheet 330 and forms a second interlocking member 360. A third portion 349 of second skin 334 extends beyond second face 332 of second foam sheet 330 and forms a second complementary interlocking member 362. In the embodiment of FIG. 6, second interlocking member 360 includes a second convex surface 364 formed by a second curve 366 in second skin 334. Second complementary interlocking member 362 includes a second concave surface 368 formed by a curve 370 in second skin 334.

Figure 7:
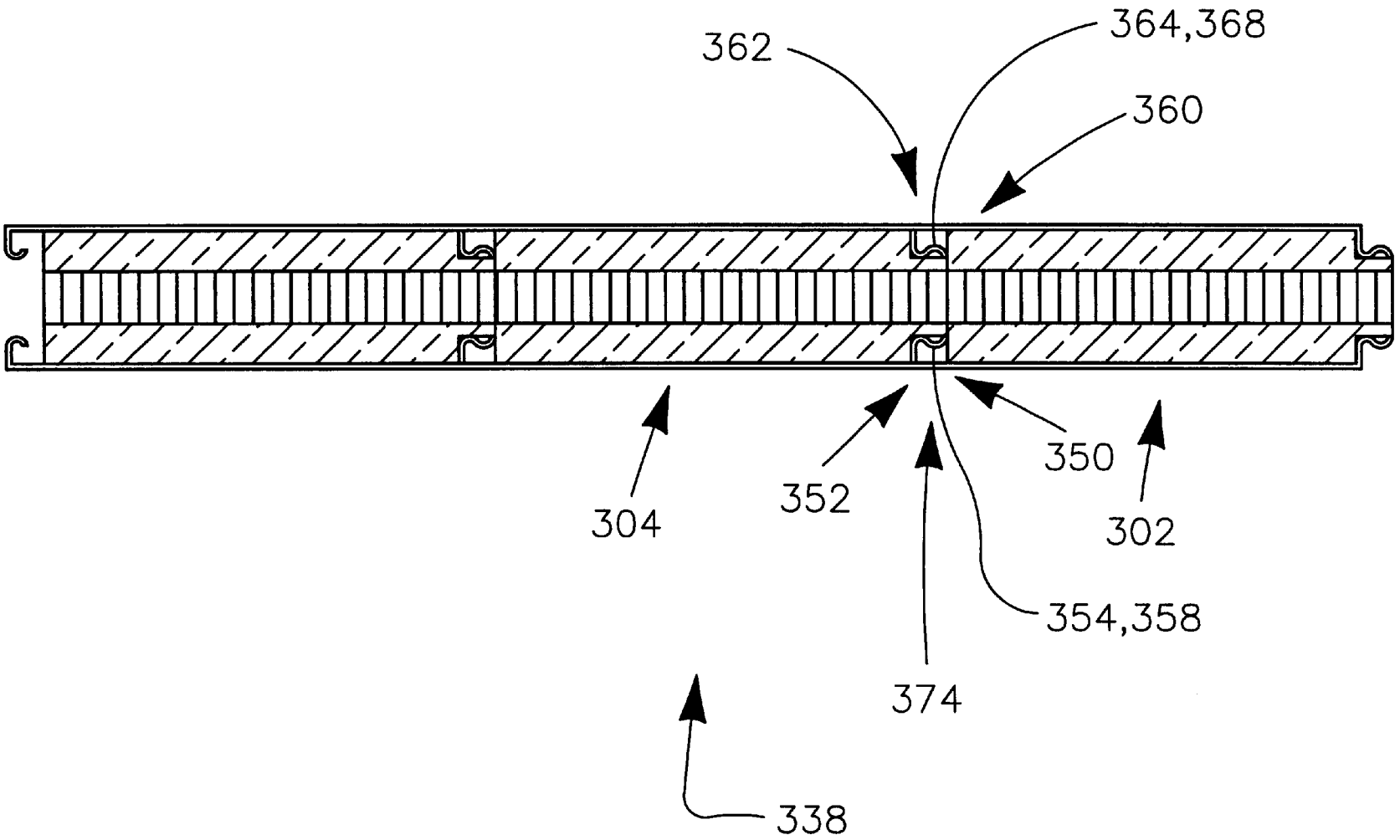

FIG. 7 is a cross sectional view including a plurality of building panels arranged to form an assembly 338. In FIG. 7, a first building panel 302 has been selectively coupled with a second building panel 304. First interlocking member 350 and second interlocking member 360 of second building panel 304 have engaged first complementary interlocking member 352 and second complementary interlocking member 362 to form a joint 374. As shown in FIG. 7, first convex surface 354 of first interlocking member 350 is disposed proximate first concave surface 358 of first complementary interlocking member 352. Likewise, second convex surface 364 of second interlocking member 360 is disposed proximate second concave surface 368 of second complementary interlocking member 362. A layer of sealant may be disposed between each convex surface and each complementary concave surface.

Figure 8:
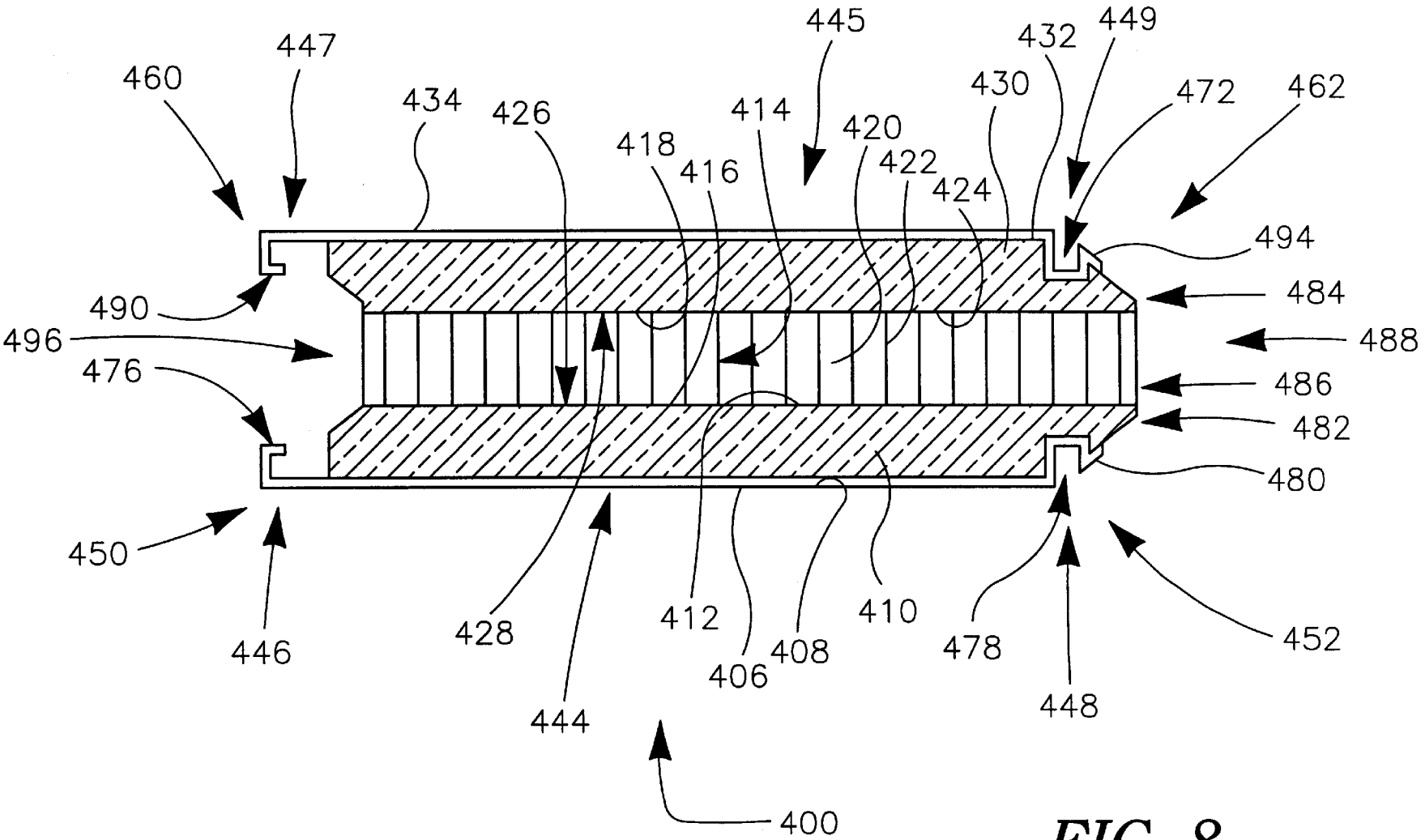
FIG. 8 is a cross sectional view of a building panel in accordance with the present invention.

FIG. 8 is a cross sectional view of a building panel 400 in accordance with the present invention. Building panel 400 includes a first skin 406 and a first foam sheet 410 having a first face 408 and a second face 412. A first portion 444 of first skin 406 is bonded to a first face 408 of first foam sheet 410. A second portion 446 of first skin 406 extends beyond first face 408 of first foam sheet 410 and forms a first interlocking member 450. In the embodiment of FIG. 8, first complementary interlocking member 452 includes a first rib 476 defined by first skin 406. A third portion 448 of first skin 406 extends beyond first face 408 of first foam sheet 410 and forms a first complementary interlocking member 452. In the embodiment of FIG. 8, first complementary interlocking member 452 includes a first channel 478 and a first ramp 480 defined by first skin 406. A first tongue portion 482 of first foam sheet 410 extends beyond first channel 478.

A second face 412 of first foam sheet 410 is fixed to a cellular network 414. Cellular network 414 includes a first face 416, a second face 418, and a plurality of cells 420 defined by a plurality of cell walls 422. In the embodiment of FIG. 8, each cell 420 also includes a first opening 426 disposed proximate first face 416 of cellular network 414 and a second opening 428 disposed proximate second face 418 of cellular network 414. Second face 418 of cellular network 414 is fixed to a first face 424 of a second foam sheet 430. Second foam sheet 430 also has a second face 432.

Building panel 400 includes a second skin 434, a first portion 445 of second skin 434 is bonded to second face 432 of second foam sheet 430. A second portion 447 of second skin 434 extends beyond second face 432 of second foam sheet 430 and forms a second interlocking member 460. A third portion 449 of second skin 434 extends beyond second face 432 of second foam sheet 430 and forms a second complementary interlocking member 462.

In the embodiment of FIG. 8, second interlocking member 460 includes a second rib 490 defined by second skin 434. Second complementary interlocking member 462 includes a second channel 492 and a second ramp 494 defined by second skin 434. A second tongue portion 484 of second foam sheet 430 extends beyond second channel 492.

Building panel 400 includes a tongue 488. Tongue 488 includes first tongue portion 482 of first foam sheet, second tongue portion 484 of second foam sheet, and a tongue portion 486 of cellular network 414. Building panel 400 also includes a groove 496 defined by first foam sheet 410, second foam sheet 430, and cellular network 414.

Figure 9:
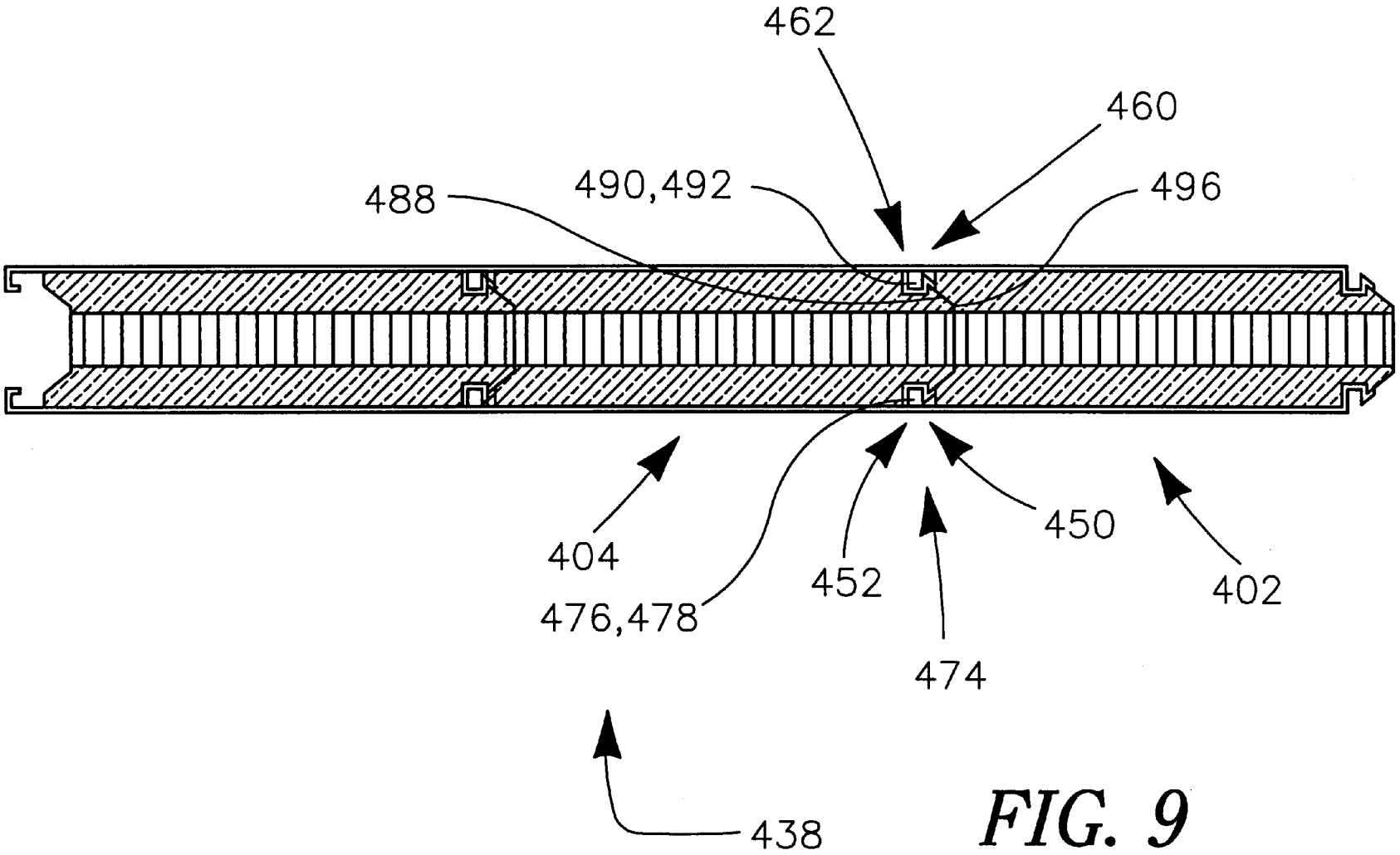

FIG. 9 is a cross sectional view of an assembly 438 formed by a plurality of building panels. In FIG. 9, a first building panel 402 has been selectively coupled with a second building panel 404. First interlocking member 450 and second interlocking member 460 of second building panel 404 have engaged first complementary interlocking member 452 and second complementary interlocking member 462 of first building panel 402 to form a joint 474.

As shown in FIG. 9, first rib 476 of first interlocking member 450 is disposed within first channel 478 of first complementary interlocking member 452. Likewise, second rib 490 of second interlocking member 460 is disposed within second channel 492 of second complementary interlocking member 462. A layer of sealant may be disposed between each rib and each complementary channel.

First ramp 480 and second ramp 494 may aid in interconnecting first building panel 402 and second building panel 404. Tongue 488 of first building panel 402 is disposed within groove 496 of second building panel 404.

Having thus described the figures, a method in accordance with the present invention may know be described with reference thereto. It should be understood that steps may be omitted from this process and/or the order of the steps may be changed without deviating from the spirit or scope of the invention. It is anticipated that in some applications, two or more steps may be performed essentially simultaneously to promote efficiency.

A method in accordance with the present invention may include the step of forming a cellular network. Methods of forming a cellular network which may be suitable in some applications have been described previously.

A process in accordance with the present invention may include the step of forming an interlocking element along a first edge of a sheet of skin material and forming a complementary interlocking element along a second edge of the skin.

Adhesive may be applied to one side of the skin, and the skin may be pressed against a first face of a foam sheet. The adhesive may be allowed to cure.

A second face of the foam sheet may be bonded to a first face of the cellular network. Adhesive may be applied to the second face of the foam sheet and/or the first face of the cellular network to aid in fixing the foam sheet to the cellular network.

A second face of the cellular network may be bonded to a first face of a second foam sheet. Again, adhesive may be applied to the second face of the cellular network and/or the first face of the second foam sheet to aid in fixing these elements together. A second skin may be bonded to a second face of the second foam sheet by applying adhesive and placing these elements in close proximity to each other.

In one method in accordance with the present invention, a complete building panel assembly is created by applying adhesives and overlaying subsequent layers until the assembly is complete. The multiple layers of adhesive in the assembly are then allowed to cure. In another method in accordance with the present invention, a plurality of building panel assemblies are arranged one on top of the other to create a stack. Compressive forces may then be applied to the top and bottom of the stack to assure that the elements of each building panel are pressed together while the layers of adhesive are allowed to cure. In some applications, heat may be utilized to accelerate the cure of the adhesives.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A building panel comprising;

a first foam sheet having a first face and a second face;

a first skin having a first portion, a second portion, and a third portion;

the first portion of the first skin being bonded to the first face of the first foam sheet;

the second portion of the first skin forming a first interlocking member;

the third portion of the first skin forming a first complementary interlocking member;

wherein the first foam sheet extends beyond the first portion of the first skin and supports the first complementary interlocking member;

a cellular network including a first face, a second face, and a plurality of cells defined by a plurality of cell walls;

the first face of the cellular network being fixed to the second face of the first foam sheet;

the second face of the cellular network being fixed to a first face of a second foam sheet;

a second skin having a first portion, a second portion, and a third portion;

the first portion of the second skin being bonded to the second face of the second foam sheet;

the second portion of the second skin forming a second interlocking member;

the third portion of the second skin forming a second complementary interlocking member; and wherein the second foam sheet extends beyond the first portion of the second skin and supports the second complementary interlocking member.

2. The building panel of claim 1 wherein the cellular network further includes a first cover and a second cover.

3. The building panel of claim 1, wherein the cellular network comprises kraft paper and a fire retardant additive.

4. The building panel of claim 1, wherein the cellular network comprises kraft paper and a water retardant coating.

5. The building panel of claim 1, wherein the cellular network comprises a thermoplastic material.

6. The building panel of claim 1, wherein the cellular network comprises a fire retardant thermoplastic material.

7. The building panel of claim 1, wherein the first foam sheet and the second foam sheet are comprised of a foamed in place polyurethane foam.

8. The building panel of claim 1, wherein the first foam sheet and the second foam sheet are comprised of a foamed fire retardant thermoplastic.

9. The building panel of claim 1, wherein the first foam sheet and the second foam sheet are comprised of expanded polystyrene.

* * * * *